United States Patent [19]

Kadija

[11] 4,289,601

[45] Sep. 15, 1981

[54] DIAPHRAGM STRUCTURE FOR ELECTROLYTIC CELLS FOR THE ELECTROLYSIS OF AQUEOUS SALT SOLUTIONS

[75] Inventor: Igor V. Kadija, Cleveland, Tenn.

[73] Assignee: Olin Corporation, New Haven, Conn.

[21] Appl. No.: 99,047

[22] Filed: Nov. 30, 1979

[51] Int. Cl.[3] ..... C25B 13/08

[52] U.S. Cl. ..... 204/296

[58] Field of Search ..... 204/296, 295

[56] References Cited

U.S. PATENT DOCUMENTS 3,923,630 12/1975 Argade et al. ..... 204/266

4,062,753 12/1977 Falvo ..... 204/266

4,124,458 11/1978 Moeglich ..... 204/98

4,165,271 8/1979 Kadija ..... 204/252

4,167,469 9/1979 Kadija et al. ..... 204/296

*Primary Examiner*—F. Edmundson

*Attorney, Agent, or Firm*—James B. Haglind; Donald F. Clements

[57] ABSTRACT

A diaphragm for electrolytic cells for the electrolysis of aqueous salt solutions is comprised of a porous portion and an impervious portion. The impervious portion is comprised of a fabric layer attached to an impervious film layer. A thermoplastic fabric material is used as the porous portion which is impregnated with a siliceous composition as the electrolytically active component.

8 Claims, 3 Drawing Figures

DIAPHRAGM STRUCTURE FOR ELECTROLYTIC CELLS FOR THE ELECTROLYSIS OF AQUEOUS SALT SOLUTIONS

This invention relates to diaphragm-type electrolytic cells for the electrolysis of aqueous solutions of ionic compounds. More particularly, this invention relates to novel diaphragms for electrolytic diaphragm cells.

In an electrolytic diaphragm cell, the diaphragm represents the cell component which permits the cell to operate by producing gaseous and liquid products while providing where necessary separation of these products. Frequently, the diaphragm structure used covers one of the cells electrodes, for example, the cathodes. The electrodes, in addition to having active areas at which electrolysis takes place, have sections which are electrolytically inactive but which require covering with a fluid impermeable material. In addition to being fluid impermeable, the impervious portion of the diaphragm structure should be compatible with and readily attached to the porous active portion of the diaphragm structure.

Recently novel diaphragms have been produced which employ a support fabric impregnated with a siliceous material as described, for example, in U.S. Pat. No. 4,165,271 issued Aug. 21, 1979 to the Applicant. Various methods have been employed to render portions of the support fabric which cover inactive portions of the electrode impervious to fluids. None of these, however, were fully satisfactory.

It is an object of the present invention to provide a diaphragm structure suitable for covering electrode structures.

Another object of this invention is to provide a diaphragm structure which is impervious to fluids at inactive areas of diaphragm-covered electrodes.

An additional object of the invention is to provide an impervious sealing composition suitable for use as a gasket material.

These and other objects of the invention are provided by a diaphragm for electrolytic cells for the electrolysis of aqueous salt solutions which comprises a porous portion attached to an impervious portion, the impervious portion having at least two layers.

In the accompanying drawings, various embodiments of the invention are illustrated.

Figures 1, 2, 3:
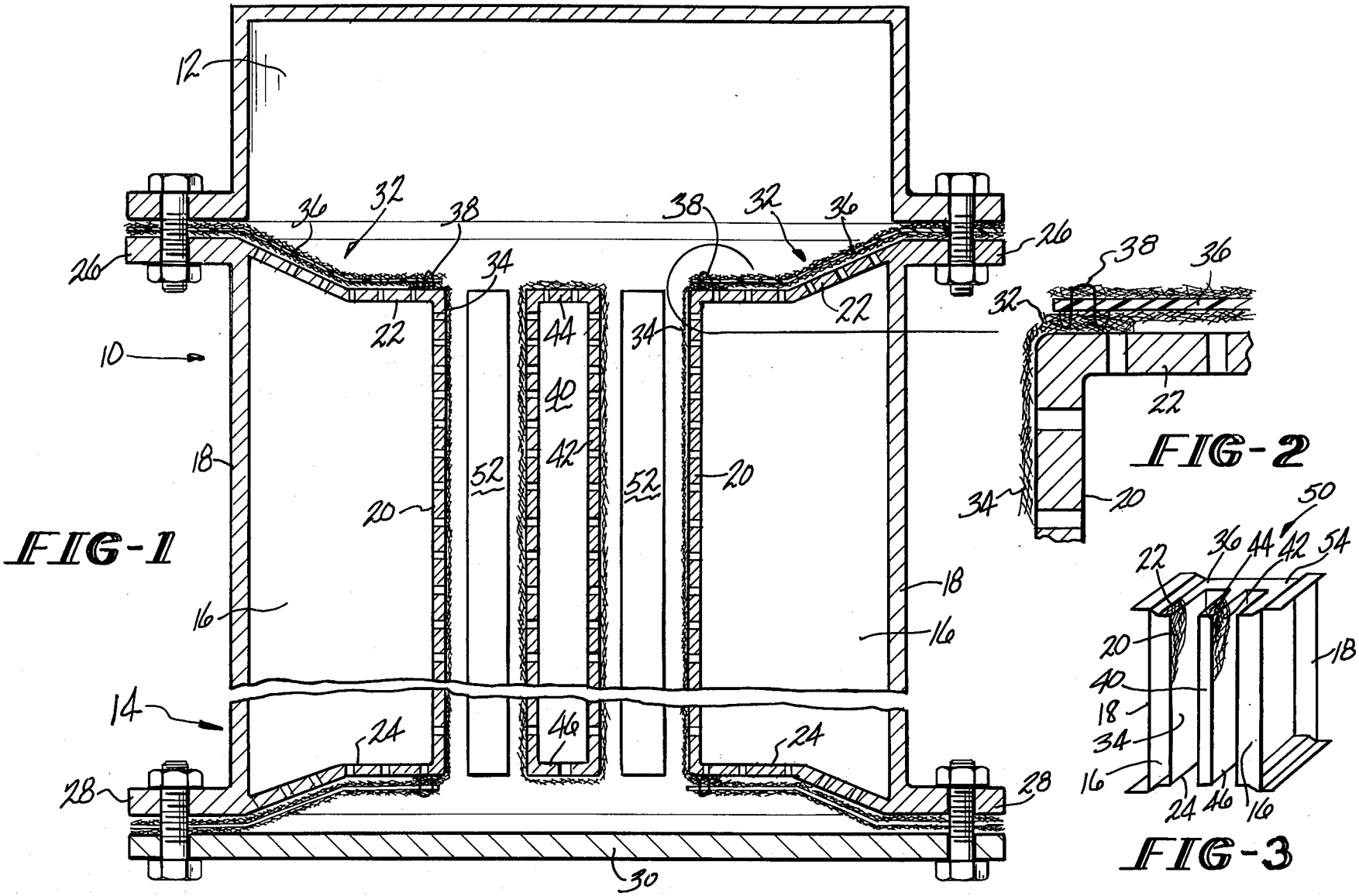
FIG. 1 shows an end view of a cross section of an electrolytic cell employing the novel diaphragm structure of the present invention.
FIG. 2 illustrates an enlarged partial section of FIG. 1.
FIG. 3 represents a perspective view of a cathode section covered by an embodiment of the diaphragm structure of the present invention.

FIG. 1 shows electrolytic cell 10 having cover 12 and cell body 14. Cell body 14 contains cathode assembly 50 comprised of external cathodes 16 and internal cathode 40. External cathodes 16 having external walls 18, foraminous walls 20, foraminous top sections 22 and foraminous bottom sections 24. External walls 18 have upper flanges 26 and lower flanges 28 which are utilized to seal in a liquid tight manner cell body 14 to cover 12 and cell bottom 30. Inner cathode 40 has foraminous walls 42, foraminous top section 44 and foraminous bottom section 46. Anodes 52 are contained within cell body 14 and are inserted between the spaced apart from cathodes 16 and 40.

Diaphragm structure 32 is comprised of porous sections 34 and impervious sections 36. Foraminous walls 20 and 42 are covered with porous sections 34 of diaphragm structure 32. Foraminous top sections 22 and 44 and foraminous bottom sections 24 and 46 are covered by impervious sections 36 of diaphragm structure 32. Porous sections 34 are joined to impervious section 36 at junctions 38. Impervious portions 36 are extended to cover upper flanges 26 and bottom flanges 28 as a gasket material.

FIG. 2 presents an enlarged section of FIG. 1 showing a portion of foraminous wall 20 covered by porous section 34 of diaphragm structure 32, a portion of foraminous top section 22 covered by impervious section 36 of diaphragm structure 32; and their attachment at junction 38.

FIG. 3 shows a perspective view of cathode assembly 50 having outer cathodes 16 and inner cathode 40 connected by cell walls 54. Foraminous top sections 22 and 44 form the top of cathode assembly 50 while foraminous bottom sections 24 and 46 form the bottom of cathode assembly 50.

The novel diaphragm structures of the present invention are comprised of a porous section and an impervious section.

As the porous section, a porous fabric is employed which is produced from materials which are chemically resistant to and dimensionally stable in the gases and electrolytes present in the electrolytic cell. The fabric is substantially non-swelling, non-conducting and non-dissolving during operation of the electrolytic cell. The fabric is also non-rigid and is sufficiently flexible to be shaped to the contour of an electrode if desired.

Suitable porous fabrics are those which can be handled easily without suffering physical damage. This includes handling before and after they have been impregnated with the siliceous composition which serves as the electrolytically active component. Suitable fabrics are those which can be removed from the cell following electrolysis, treated or repaired, if necessary, and replaced in the cell for further use without suffering substantial degradation or damage.

Porous fabrics used as the porous portion of the diaphragm structure, prior to impregnation with the siliceous composition, should have a permeability to gases such as air of, for example, from about 5 to about 500, preferably from about 20 to about 200, and more preferably from about 30 to about 100 cubic feet per minute per square foot of fabric. Uniform permeability throughout the fabric is not, however, required and it may be advantageous to have a greater permeability in one portion of the porous fabric.

Materials which are suitable for use as porous fabrics for the porous portion of the diaphragm structure include thermoplastic materials such as polyolefins which are polymers of olefins having from about 2 to about 6 carbon atoms in the primary chain as well as their chloro- and fluoro- derivatives.

Examples of suitable thermoplastic materials include polyethylene, polypropylene, polybutylene, polypentylene, polyhexylene, polyvinyl chloride, polyvinylidene chloride, polytetrafluoroethylene, fluorinated ethylene-propylene (FEP), polychlorotrifluoroethylene, polyvinyl fluoride, polyvinylidene fluoride, and copolymers of ethylene-chlorotrifluoroethylene.

Preferred olefins include the chloro- and fluoro- derivatives such as polytetrafluoroethylene, fluorinated ethylene-propylene (FEP), polychlorotrifluoroethylene, polyvinyl fluoride, and polyvinylidene fluoride.

Also suitable as porous fabric materials are polyaromatic compounds such as polyarylene compounds. Polyarylene compounds include polyphenylene, polynaphthylene and polyanthracene derivatives. For example, polyarylene sulfides such as polyphenylene sulfide or polynaphthylene sulfide. Polyarylene sulfides are well known compounds whose preparation and properties are described in the *Encyclopedia of Polymer Science and Technology* (Interscience Publishers) Vol. 10, pages 653–659. In addition to the parent compounds, derivatives having chloro-, fluoro- or alkyl substituents may be used such as poly(perfluorophenylene) sulfide and poly(methylphenylene) sulfide.

Porous fabrics which are mixtures of fibers of polyolefins and fibers of polyarylene sulfides can be suitably used as well as layered fabrics in which the first layer is a polyolefin such as polytetrafluoroethylene and the second layer is a polyarylene sulfide such as polyphenylene sulfide.

Suitable forms of fabrics for the porous portion are those which promote adsorption of the siliceous component including sponge-like fabric forms. Preferred forms of fabric are felt fabrics, i.e., fabrics having a high degree of interfiber entanglement or interconnection which are usually non-woven. The felt fabrics are treated, for example, by needling to facilitate passage of fluids and provide the desired permeability.

The fabric of the porous section of the diaphragm structure is impregnated with a siliceous composition which serves as the electrolytically active material in the diaphragm. Suitable siliceous compositions include those which are capable of undergoing hydration when in contact with the electrolytes in the cell. A large number of siliceous materials can be used including sand, quartz, silica sand, colloidal silica, as well as chalcedony, cristobalite and tripolite. Also suitable are alkali metal silicates such as sodium silicate, potassium silicate and lithium silicate; alkaline earth metal silicates such as magnesium silicates or calcium silicates; and aluminum silicates. In addition, a number of minerals can be suitably used as the siliceous component, including magnesium-containing silicates such as sepiolites, meerschaums, augites, talcs and vermiculites; magnesium-aluminum-containing silicates such as attapulgites, montmorillonites and bentonites, and alumina-containing silicates such as albites, feldspars, labradorites, microclines, nephelites, orthoclases, pyrophyllites, and sodalites, as well as natural and synthetic zeolites.

When using as the siliceous component a silica component such as sand, quartz, silica sand, colloidal silica, chalcedony, cristobalite, tripolite and alkali metal silicates, it may be desirable to include an additive which provides improved ionic conductivity and cation exchange properties. Suitable additives include, for example, magnesia, magnesium acetate, magnesium aluminate, magnesium carbonate, magnesium chloride, magnesium hydroxide, magnesium oxide, magnesium peroxide, magnesium silicate, magnesite, periclase, dolomites, alumina, aluminum acetate, aluminum chlorate, aluminum chloride, aluminum hydroxide, aluminum oxides ($\alpha$, $\beta$ and $\gamma$), aluminum silicate, corundum, bauxites as well as lime, lithium salts such as lithium chloride and lithium nitrate inorganic phosphates such as aluminum phosphates and sodium phosphates.

The additives may be used in the amounts of from about 10 to about 70 and preferably from about 20 to about 50 percent by weight of the siliceous component.

When impregnated, the porous section of the novel diaphragm structure of the present invention contains from about 10 to about 100, preferably from about 25 to about 75, and more preferably from about 30 to about 50 milligrams of the siliceous component per square centimeter of support fabric.

The imprevious portion of the diaphragm structure has at least two layers. One layer is an impervious film of a synthetic thermoplastic resin. Examples of suitable synthetic thermoplastic resins include halogenated polyolefins, such as polyvinyl chloride, polyvinylidene chloride, polytetrafluoroethylene, fluorinated ethylene-propylene (FEP), polychlorotrifluoroethylene, polyvinyl fluoride, polyvinylidene fluoride, polymerized perfluoroalkyls having the formula $CF_2CF_2CFO(CnF_{2n-1})CF_2CF_2$, where n is from 1 to about 10, and copolymers thereof, where the halogens are chlorine or fluorine.

The thermoplastic film layer may be any suitable thickness, for example, from about 1 to about 25 mils.

A preferred thermoplastic film is that which is available commercially as an "activated" film.

The second layer of the impervious portion of the diaphragm structure is a thermoplastic fabric material. Preferred as the fabric layer of the impervious portion of the diaphragm structure are felt fabrics and non-woven fabrics, with felt fabrics being particularly preferred. Felt fabric layers are preferably those having a light weight, for example, from about 5 to about 20 ounces per square yard.

Materials which are suitable for use in the fabric layer of the imprevious portion of the diaphragm structure are the same as those used as the porous fabric and include thermoplastic materials such as polyolefins which are polymers of olefins having from about 2 to about 6 carbon atoms in the primary chain as well as their chloro- and fluoro- derivatives.

Examples of suitable polyolefin materials used as materials of construction of the fabric layer include polyethylene, polypropylene, polybutylene, polypentylene, polyhexylene, polyvinyl chloride, polyvinylidene chloride, polytetrafluoroethylene, fluorinated ethylene-propylene (FEP), polychlorotrifluoroethylene, polyvinyl fluoride, polyvinylidene fluoride, and copolymers of ethylene-chlorotrifluoroethylene.

Preferred olefins include the chloro- and fluoro- derivatives such as polytetrafluoroethylene, fluorinated ethylene-propylene (FEP), polychlorotrifluoroethylene, polyvinyl fluoride, and polyvinylidene fluoride.

Also suitable are polyaromatic compounds such as polyarylene compounds. Polyarylene compounds include polyphenylene, polynaphthylene and polyanthracene derivatives. For example, polyarylene sulfides such as polyphenylene sulfide or polynaphthylene sulfide.

In selecting materials for the impervious film layer and fabric layer of the impervious portion of the diaphragm structure, thermoplastic materials in the film layer preferably have a lower melting point to permit bonding to the fabric layer, for example, by heat sealing at temperatures which will not thermally damage the fabric layer.

In a preferred embodiment, the impervious portion of the diaphragm structure is comprised of two layers of fabric material separated by the film layer. A suitable example comprises a film layer of fluorinated ethylene-propylene placed between two layers of a polytetrafluoroethylene felt fabric. The layers may be bonded, for example, by sealing with energy forms such as heat or ultrasonic vibrations.

By applying, for example, heat and pressure, the impervious film is melted to the extent that it allows partial incorporation of the fibers of the fabric. This incorporation of fibers into the impervious film layer improves the mechanical properties of the film and strengthens the impervious layer.

When bonding the fabric layer to the impervious film layer, suitable temperatures are those from about 100 to those at which the thermoplastic fabric suffers minimal thermal decomposition. Preferred temperatures are those in the range from about 200° to about 300° C. Suitable pressures are those in the range of from about 1 to about 200, and preferably from about 20 to about 150 pounds per square inch (psi).

To form the complete diaphragm structure, the porous portion is attached to the impervious portion. Suitable methods of attachment include, for example, sewing, heat sealing, ultrasonic sealing, or the like. In a preferred method, the porous portion of the diaphragm structure is joined to the impervious portion, for example, by hand stitching or machine sewing and energy such as heat or ultrasonic vibrations is applied to this juncture to soften the film layers sufficiently to seal any perforations which may have been made during the sewing operation. A mechanically strong, fluid-tight juncture or seam is formed in which the porous portion of the diaphragm structure is mechanically reinforced by the impervious portion.

The impervious portion of the diaphragm may also be used independently of the porous section as a sealing composition. As an impervious sealing composition, it is flexible and sufficiently elastic to be used, for example, as a gasket material in any cell areas where fluid-tight seals are required, as shown in FIG. 1.

Other sealing materials such as neoprene rubber or ethylene-propylene-dieme terpolymers (EPDM) may be used together with the impervious sealing composition as these materials can be readily bonded together, for example, with an adhesive.

Improved sealing properties may be obtained by coating the fabric layers of the impervious sealing composition with silicone rubber or polysulfides.

Electrolytic cells in which the diaphragm structure of the present invention may be used are those, for example, which are employed commercially in the production of chlorine and alkali metal hydroxides by the electrolysis of alkali metal chloride brines. Alkali metal chloride brines electrolyzed are aqueous solutions having high concentrations of the alkali metal chlorides. For example, where sodium chloride is the alkali metal chloride, suitable concentrations include brines having from about 200 to about 350, and preferably from about 250 to about 320 grams per liter of NaCl. The cells have an anode assembly containing a plurality of foraminous metal anodes, a cathode assembly having a plurality of foraminous metal cathodes with the novel diaphragm separating the anodes from the cathodes. Suitable electrolytic cells include, for example, those types illustrated by U.S. Pat. Nos. 1,862,244; 2,370,087; 2,987,463; 3,247,090; 3,477,938; 3,493,487; 3,617,461; and 3,462,604.

The following EXAMPLE is presented to illustrate more fully the invention without any intention of being limited thereby. All parts and percentages are by weight unless otherwise indicated.

EXAMPLE

A cathode assembly of the type illustrated in FIG. 3 was covered with a diaphragm structure comprised of a polytetrafluoroethylene felt fabric as the porous portion and two layers of a polytetrafluoroethylene felt fabric bonded to an intermediate layer of fluorinated ethylene-propylene (FEP) film as the impervious portion. The porous polytetrafluoroethylene felt fabric was 0.12 centimeter thick and had an air permeability in the range of from about 20 to about 70 cubic feet per minute per square foot.

The impervious portion was formed by inserting a layer of an impervious fluorinated ethylene-propylene film (Livingston Coatings, Inc. activated film) about 0.015 centimeter thick between two layers of polytetrafluoroethylene felt fabric (weight—10 ozs./sq. yd.).

Fabrication of the impervious layered structure was completed by heat sealing the structure at a temperature of 275° C. under a pressure of 122 psi.

The impervious portions were joined to the porous portions by stitching the sections together with a polytetrafluoroethylene thread to form an overlap seam.

Joining of the impervious sections to the porous sections of the diaphragm structure was completed by manually applying an ultrasonic welding gun along the seam areas to provide a temperature of about 200° C. and a sealing time of about 2 seconds.

The cathode assembly was then covered with the impervious portions and porous portions of the diaphragm structure as illustrated in FIGS. 1 and 3.

The impervious portions served as the gasket material along the flanges where the cell cover and cell bottom were attached to the cell body. These areas of the impervious portions were coated with silicone rubber prior to bolting the cell cover and the cell bottom.

The covered cathode assembly was immersed in sodium chloride brine having a concentration of 295–305 grams per liter of NaCl and 5 percent by volume of sepiolite mineral. A vacuum was applied to impregnate the porous section of the diaphragm structure with the sepiolite dispersion.

The cathode assembly was installed in an electrolytic cell of the type shown in FIG. 1.

The cell was equipped with ruthenium oxide coated titanium mesh anodes and the anode compartments were filled with sodium chloride brine at a pH of 12, a concentration of 300±5 grams per liter of NaCl and a temperature of 90° C. Electrolysis was conducted employing a current density of 2.0 kiloamps per square meter of anode surface. The cell was operated to produce chlorine gas and a sodium hydroxide solution. No leakage of fluids occurred in the flange areas where the impervious portion served as the gasket material. During the period of operation, the cell was disassembled and reassembled several times without damaging the diaphragm structure by forming holes or cracks in either the impervious portions or the porous portions nor at the seams where these portions were joined.

What is claimed is:

1. A diaphragm for electrolytic cells for the electrolysis of aqueous salt solutions which comprises an electrochemically active porous portion attached to an electrochemically inactive fluid impervious portion, said electrochemically inactive fluid impervious portion being comprised of a fabric layer attached to a fluid impervious film layer.

2. The diaphragm of claim 1 in which said porous portion is comprised of a porous thermoplastic fabric impregnated with particles of a siliceous composition.

3. The diaphragm of claim 2 in which said fluid impervious film layer is comprised of a fluorinated olefin selected from the group consisting of polytetrafluoroethylene, fluorinated ethylene-propylene (FEP), polychlorotrifluoroethylene, polyvinylfluoride, and polyvinylidene fluoride.

4. The diaphragm of claim 3 in which said porous portion is a porous thermoplastic fabric comprised of a polyolefins, polyarylene sulfides, or mixtures thereof.

5. The diaphragm of claim 4 in which said polyolefin is selected from the group consisting of olefins having from 2 to about 6 carbon atoms and their chloro- and fluoro- derivatives.

6. The diaphragm of claim 4 in which said polyarylene sulfide is polyphenylene sulfide or polynaphthylene sulfide.

7. The diaphragm of claim 1 in which said fluid impervious layer is comprised of two fabric layers bonded to an intermediate impervious film layer.

8. The diaphragm of claim 7 in which said porous thermoplastic fabric is impregnated with a siliceous composition.

* * * * *